United States Patent [19]

Chrtek et al.

[11] 4,166,356

[45] Sep. 4, 1979

[54] METHOD OF AND APPARATUS FOR PNEUMATICALLY REMOVING A FIBROUS RIBBON OR A SEVERED YARN END FROM THE SPINNING ROTOR OF AN OPEN-END SPINNING MACHINE

[75] Inventors: Milan Chrtek, Ceska Trebova; Frantisek Tuma; Josef Gábler, both of Usti n. Orlici; Karel Kašpárek, Bohusova; Ján Blasko, Usti n. Orlici, all of Czechoslovakia

[73] Assignee: Vyzkumny ustav bavlnarsky, Usti nad Orlici, Czechoslovakia

[21] Appl. No.: 868,497

[22] Filed: Jan. 11, 1978

[51] Int. Cl.[2] ..... D01H 11/00; D01H 1/12

[52] U.S. Cl. ..... 57/302; 57/304; 57/58.89

[58] Field of Search ..... 57/34.5, 56, 156, 58.89–58.95, 57/34 R

[56] References Cited

U.S. PATENT DOCUMENTS

| | | | |
|---|---|---|---|
| 3,360,917 | 1/1968 | Kubovy et al. | 57/56 X |
| 3,597,911 | 8/1971 | Schiltknecht | 57/56 |
| 3,698,175 | 10/1972 | Dykast | 57/56 X |
| 3,796,034 | 3/1974 | Grau | 57/56 |
| 3,810,352 | 5/1974 | Miyazaki et al. | 57/56 X |
| 3,845,612 | 11/1974 | Chisholm et al. | 57/56 |
| 3,859,779 | 1/1975 | Furstenberg | 57/56 X |
| 3,895,483 | 7/1975 | Grau | 57/56 |
| 4,028,136 | 6/1977 | Kamp | 57/56 X |
| 4,057,955 | 11/1977 | Roerich | 57/56 |
| 4,058,963 | 11/1977 | Stahlecker | 57/56 |

*Primary Examiner*—John Petrakes

[57] ABSTRACT

A method of and an apparatus for pneumatically removing a fibrous ribbon or a severed yarn end from the spinning rotor of an open-end spinning machine in the event of an interruption in the spinning process having the steps of withdrawing the fibrous ribbon or severed yarn end from the spinning rotor by directing a first pressure air stream against the mouth of an air withdrawing duct, and scavenging the spinning rotor by directing a second pressure air stream against a collecting channel of the spinning rotor in order to remove any severed fibers and impurities.

10 Claims, 6 Drawing Figures

METHOD OF AND APPARATUS FOR PNEUMATICALLY REMOVING A FIBROUS RIBBON OR A SEVERED YARN END FROM THE SPINNING ROTOR OF AN OPEN-END SPINNING MACHINE

BACKGROUND OF THE INVENTION

The present invention relates to the art of removing a fibrous ribbon or a severed yarn end from a spinning rotor of an open-end spinning machine in the event that there is an interruption of the spinning process. Such interruptions typically occur either because there is a yarn breakage or for some other reasons such as a power failure, routine maintenance, or machine failure.

There are many positive factors which result from open-end spinning machine operation. Among these are improved yarn quality and a reduction in labor cost. The negative factors which occur arise from the interruption of the spinning process due either to machine stoppage or yarn breakage.

If such interruption in the spinning process occurs, it is necessary to remove from the spinning rotor the fibers, fibrous ribbons, or yarn ends which have been sucked into the rotor after the yarn has been severed. Previously known methods have used either periodic or continuous spinning rotor cleaning devices. Such known devices, however, are not realiable in operation.

In spinning operations, fibers are spun to create yarns which are then typically either woven or knitted into fabric. If the yarn is twisted it may be made into thread.

SUMMARY OF THE INVENTION

The present invention relates to a method which includes the steps of removing the fibrous ribbons or severed yarn ends by a pressure stream of air flowing in the plane of the spinning rotor front portion and directed toward the mouth of the air withdrawing duct. In addition, the spinning rotor itself is scavenged by a second air pressure or air stream directed toward the collecting channel of the spinning rotor in order to remove any fiber remainders or impurities which have remained inside the spinning rotor.

The apparatus for carrying out the method is also an object of the invention. The apparatus has a spinning rotor which is conventional and a cover which has a fiber supply duct, a fibrous ribbon removing nozzle whose mouth or outlet orifice, when in the position of relative disengagement of the spinning rotor and the cover, substantially lies in the plane of the spinning rotor front opening and is directed toward the air withdrawing duct.

The cover is also provided with an auxiliary nozzle with an outlet orifice which is directed in the spinning position toward the collecting channel of the spinning rotor so that in an axial view of the spinning rotor a geometric projection of the auxiliary nozzle axis onto a plane perpendicular to the spinning rotor axis and crossing the collecting surface includes an angle from about 60° to about 75° with a tangent drawn through the intersection of that axis with the collecting surface.

The inventive structure and method includes the utilization of the pressure air streams which are discharged from both the fibrous ribbon removing nozzle and the auxiliary nozzle for removing fiber remainders and impurities to be actuated in short intervals in successive order, i.e. one after the other and not at the same time.

DESCRIPTION OF THE PREFERRED EMBODIMENT

Figure 1:
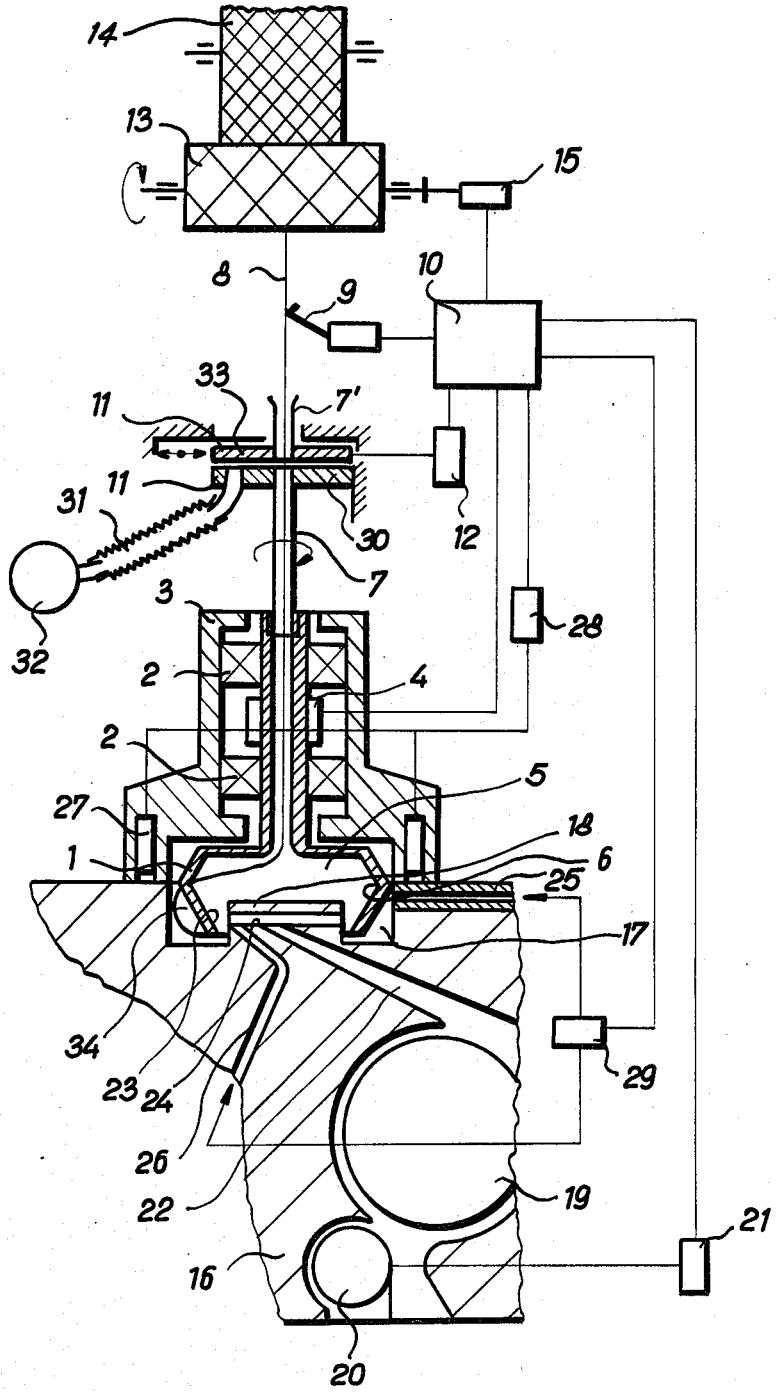
FIG. 1 is a plan view of a mutual arrangement of the bobbin, transverse roller, cutting mechanism, the spinning rotor and the cover with the ducts, nozzles and channels.

A spinning rotor 1 supported in bearings 2 is received in a casing 3 and is driven by an electric, e.g. high-speed motor 4. The cavity 5 of the spinning rotor 1 which has a collecting channel 6 therein, communicates with a yarn take-off tube 7 for taking off yarn 8. The presence of yarn 8 is sensed by a feeler 9 which forms part of a control unit 10. Yarn 8 passes through a cutting mechanism 11 controlled by a drive element 12, and is wound by means of a traverse roller 13 onto a bobbin 14. The traverse roller 13 is driven from a drive element 15.

Figure 6:
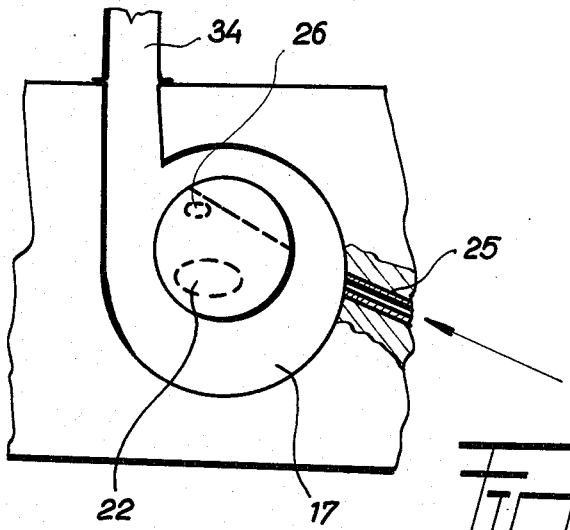
FIG. 6 is a top view of a diffusor and, in a partly sectional view, the fibrous ribbon removing nozzle.

The front opening of the spinning rotor 1 is covered or shielded, during the spinning process, by a cover 16 in a contactless manner. In the cover 16 there is provided a labyrinth recess 17 embodied as a diffusor. In the middle of said recess 17 there is provided a projection 18 shown as having a cylindrical shape and partially entering the spinning rotor 1, since the latter is received in said recess 17. The recess merges into a duct 34 (FIG. 6) for withdrawing technological air, remainders of fibrous ribbons, fibers and impurities. The cover 16 can form part of a known fiber separating device 19 for combing fibers out of a fibrous sliver supplied by a feed roller 20 which is driven from a drive element 21. In the cover 16, a fiber supply duct 22 is provided so as to point toward a sliding wall 23 of the spinning rotor 1. In the illustrative embodiment, the fiber supply duct opens into the front wall of a slot 24 provided in the projection 18. However, it is possible to use other structures having baffles or the like instead of the particular details described above.

Figure 2:
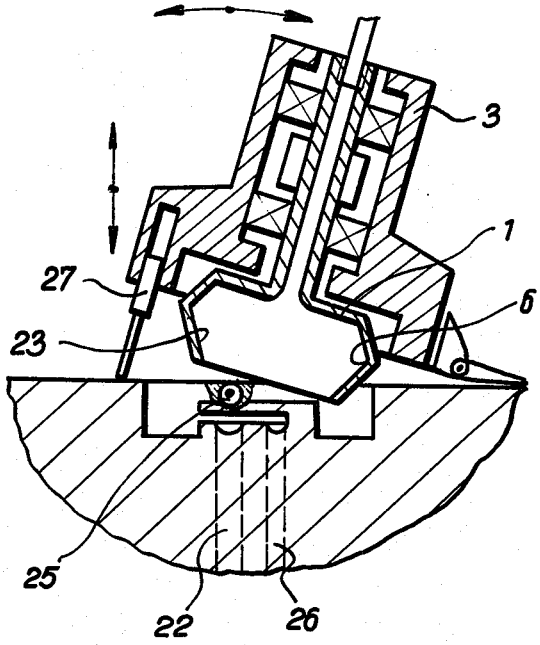
FIG. 2 shows the spinning rotor and the cover in the disengagement position as seen in axial view from the fibrous ribbon removing nozzle.
Figure 3:
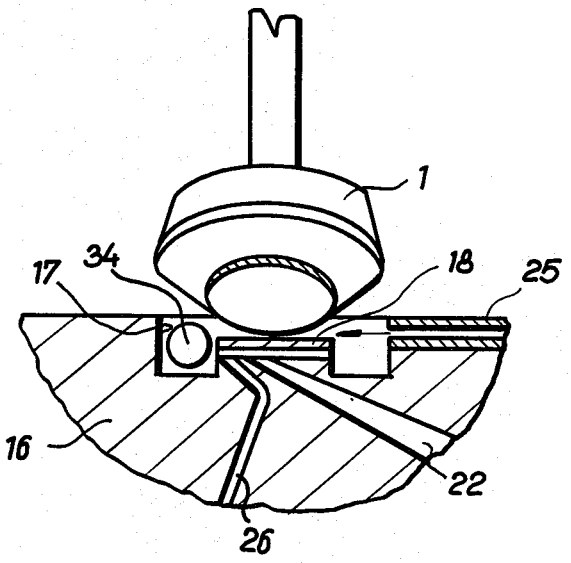
FIG. 3 is a view similar to that of FIG. 2 but seen in the direction perpendicular to the axis of the fibrous ribbon removing nozzle.
Figure 4:
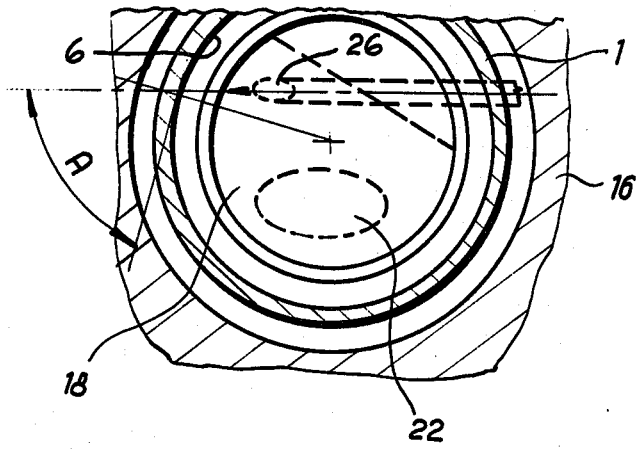
FIG. 4 is a top plan view showing the mouth of the auxiliary nozzle in the cover.

In the cover 16 there is further provided a fibrous ribbon removing nozzle 25 which opens into the lateral wall of the recess 17 in the cover 16. There is also provided in the cover 16 an auxiliary nozzle 26 which opens into the front wall of said slot 24 in the projection 18 and is directed, in the operative position of the machine, obliquely upwards to the collecting channel 6 in such a direction that (FIG. 4) the axis of said auxiliary nozzle 26 forms an angle A with a tangent drawn through the intersection of said axis with the collecting channel 6; angle varies within the range of from 60° to 75°. The relative disengagement position of the spinning rotor 1 and the cover 16 (FIGS. 2 and 3) is achieved by mechanical or pneumomechanical means 27 and drive elements 28 thereof in response to a signal given by the control unit 10. The control unit 10 further controls the drive element 15 of the traverse roller 13, the high-speed motor 4 of the spinning rotor 1, the cutting mechanism 11 and the drive element 21 of the fiber supply. Apart from this, the control unit 10 controls the operation of the fibrous ribbon removing nozzle 25 and the auxiliary nozzle 26 by means of a two-way valve 29. The operation of the control unit 10 is monitored by variable time program means.

The cutting mechanism 11 comprises e.g. a stationary plate 30 into which the yarn take-off tube 7 as well as a sucking duct 31 open; the latter is connected to a central subatmospheric pressure source 32. The mating part of the cutting mechanism 11 is constituted e.g. by a reciprocable plate 33 supported on a track (not shown) and operable by the drive element 12. The reciprocable plate 33 receives the upper section 7' of the yarn take-off tube 7.

In operation, separated fibers are conveyed onto the sliding wall 23 of the spinning rotor 1 rotating at high speed, and are deposited, due to centrifugal force, into the collecting channel 6 to form a fibrous ribbon which is then stripped off and twisted to yarn 8 in a well-known and therefore not described manner; yarn 8 is sensed by the feeler 9 and is finally wound onto the bobbin 14.

Figure 5:
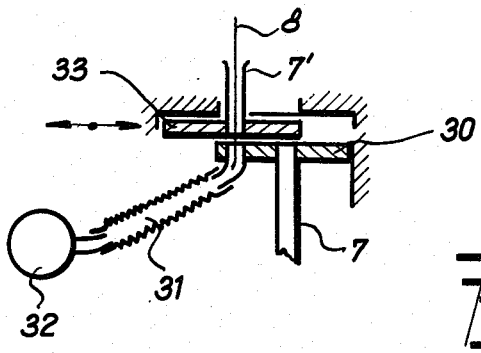
FIG. 5 is a sectional view of the cutting mechanism in the position following the yarn cutting step.

A first possible alternative (1) of removing the fibrous ribbon and the severed yarn end after a thread breakage caused by impurities accumulated in the spinning rotor cavity 5, is as follows:

In case of a breakage of yarn 8 the feeler 9 emits a signal to the control unit 10 which switches off the drive element 15 of the traverse roller 13 and consequently stops the bobbin 14 so that the end of yarn 8 may remain upstream of the cutting mechanism 11. The control unit 10 also monitors all the subsequent steps of the process according to the predetermined time program. Simultaneously with the stopping of the drive element 15, the fiber supply to the spinning rotor 1 is cut off by stopping the drive element 21 and consequently the feed roller 20. The control unit 10 sets the cutting mechanism 11 in motion by means of the drive element 12. The cutting mechanism 11 cuts off the yarn end to be sucked into the spinning rotor 1. Thus the cutting mechanism 11 assumes the position shown in FIG. 5 whereupon, owing to a slight reverse rotation of the traverse roller 13 and the bobbin 14, the yarn end depending from the bobbin 14 enters the sucking duct 31 exposed to the subatmospheric pressure.

As the spinning rotor 1 comes to a standstill, it will assume the disengagement position relative to the cover 16 (FIGS. 2 and 3) by the action of the pneumomechanical means 27 and the drive elements 28. In this position, the nozzle 25 for removing the fibrous ribbon and the yarn end sucked into the spinning rotor 1 starts its operation. An either continuous or intermittent pressure air flow, oriented towards the air withdrawing duct 34 or the outlet from the recess 17, is forced through the nozzle 25. This air ejected out of said nozzle 25 flows substantially in alignment with the front edge of the spinning rotor 1 whereby a sucking effect is generated by which the fibrous ribbon and/or the severed sucked-in yarn end is removed or sucked out of the spinning rotor 1.

The front opening of the spinning rotor 1 is then reclosed by the cover 16 and any fiber remainder is removed from the spinning rotor 1 by a continuous or intermittent superatmospheric pressure air flow blown out of the auxiliary nozzle 26 which is set in operation after the spinning rotor has been closed. The last remaining fibers and impurities are ejected from the spinning rotor 1 through a gap left between its front edge and the cover 16, into the air withdrawing duct 34 and further on to an impurity collecting receptacle.

During the operation of the auxiliary nozzle 26, the spinning rotor 1 is slowly rotated by the action of said nozzle.

After the above-described steps, the spinning rotor 1 is set in rotation by switching on the high-speed motor 4, the cutting mechanism 11 is returned into its original position while the yarn end contained in the sucking duct 31 is cut off and sucked into the subatmospheric pressure source 32. The bobbin 14 is turned in the reverse or unwinding direction, whereby the yarn end depending therefrom can be introduced back into the yarn take-off tube 7 and further on up to the spinning rotor 1 into which it is sucked, due to the subatmospheric pressure produced by the rotor by known means. Alternatively, the subatmospheric pressure may be produced by a source located outside the spinning unit. At the same time, there are supplied into the spinning rotor 1 separated fibers which form a new fibrous ribbon in the collecting channel 6 to join the end of yarn 8; the bobbin 14 then begins to rotate in the winding direction whereby the withdrawal of yarn 8 from the spinning rotor 1 is restarted and the feeler 9 is set in operation. Thus the spinning process is re-established.

A second possible alternative (2) fiber ribbon removing step is one in which the yarn end is retained in the sucking duct 31 by subatmospheric air pressure during this step and the step of cleaning the spinning rotor. This alternative does not provide for cutting off the yarn end by the cutting mechanism 11; the cutting mechanism assumes in this case the function of a displacing member. In case of a thread breakage, or of any other interruption of the spinning process, as by impurity accumulation, the feeler 9 emits a signal to the control unit 10 which stops the drive element 15 of the traverse roller 13 and thereby also stops the bobbin 14 so that the yarn end may stop in the yarn take-off tube section 7' passing through the reciprocable plate 33. The latter is displaced to assume the position shown in FIG. 5 whereby the yarn end becomes exposed to the subatmospheric pressure prevailing in the sucking duct 31 which now communicates with the tube section 7'. Thereafter the steps necessary for removing the fibrous ribbon and impurities will be effected as according to the first-described alternative (1). The spinning rotor 1 is then set in rotation and the reciprocable plate 33 is returned into the starting position, whereupon the yarn end is introduced into the spinning rotor 1 by reversing the rotation of the bobbin 14 and by the sucking effect of the spinning rotor 1. Simultaneously, separated fibers are supplied to the spinning rotor 1 and the spinning process continues as referred to in the description of the first alternative (1).

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A method of pneumatically removing a fibrous ribbon and possibly even a severed yarn end from the spinning rotor of an open-end spnning machine in the event of an interruption of the spinning process in said spinning machine, said rotor having a front opening and a collecting channel, said method comprising the successive steps of:

withdrawing the fibrous ribbon or the severed yarn end from the spinning rotor by directing a first pressure air stream along the plane of the front opening of a spinning rotor toward an air withdrawing duct; and scavenging the spinning rotor by directing a second pressure air stream against the collecting channel of the spinning rotor in order to remove any fibers and impurities therefrom.

2. The method claimed in claim 1, comprising:

utilizing subatmospheric pressure to hold the severed yarn ends in a known position.

3. The method claimed in claim 1, comprising:

severing the yarn in the machine, and when the spinning process is restarted utilizing a subatmospheric pressure to draw the new severed yarn end into the spinning rotor to be rejoined with a new yarn end.

4. An apparatus for pneumatically removing a fibrous ribbon and possibly even a severed yarn end from the spinning rotor of an open-end spinning machine in the event of an interruption of the spinning process, comprising:

a rotor having a front opening and a yarn take-off tube;

a cover adapted to close said rotor and having a fiber supply duct and an air withdrawing duct formed therein;

said rotor and cover being pivotally connected to each other; and means operatively connected to said rotor for pivoting it away from said cover before said fiber-removing nozzle is actuated;

said cover having a fibrous ribbon removing nozzle formed therein; and said nozzle having a mouth which in the cleaning position substantially lies in the plane of the spinning rotor front opening and is directed toward the mouth of said duct for withdrawing air, fibers, impurities, and possibly severed yarn ends.

5. The apparatus claimed in claim 4 wherein:

said rotor has a collecting channel formed therein; and said cover member has an auxiliary nozzle formed therein directed, when in the spinning position, toward the collecting channel in such direction that a geometric projection of the auxiliary nozzle on a plane perpendicular to the spinning rotor axis and crossing the collecting channel forms an angle ranging from about 60° to 75° with a tangent drawn through the intersection of the auxiliary nozzle axis with the collecting channel.

6. The apparatus as claimed in claim 5 comprising:

means continuously to supply air under pressure flowing from the fibrous ribbon removing nozzle and the auxiliary nozzle during the respective cleaning step.

7. The apparatus as claimed in claim 5 comprising:

means to supply air under pressure successively in short intervals during the respective cleaning step and flowing from the fibrous ribbon removing nozzle and the auxiliary nozzle.

8. The apparatus as claimed in claim 5 wherein:

said cover has a cylindrical projection;

said cover has a labyrinth recess around said cylindrical projection; and said auxiliary nozzle opens into said cylindrical projection.

9. The apparatus as claimed in claim 4, wherein said cover is provided with a cylindrical projection, said cover having a labyrinth-like recess about said cylindrical projection; and said fibrous ribbon removing nozzle is adapted to discharge pressurized air into said labyrinth-like recess.

10. The apparatus as claimed in claim 4, wherein said fibrous ribbon removing nozzle is disposed above the front opening of said rotor prior to its actuation.

* * * * *